United States Patent [19]

Schack

[11] 4,133,074

[45] Jan. 9, 1979

[54] SPRING ASSISTED DOOR CONSTRUCTION

[76] Inventor: John B. Schack, Box 588, Auburn, Wash. 98002

[21] Appl. No.: 821,535

[22] Filed: Aug. 3, 1977

[51] Int. Cl.[2] ..... E05F 1/12

[52] U.S. Cl. ..... 16/180; 16/1 C; 49/386; 109/64; 220/335

[58] Field of Search ..... 16/180–183, 16/145, 1 C, 75; 49/386; 109/64; 220/335; 267/57 R

[56] References Cited

U.S. PATENT DOCUMENTS

| | | | |
|---|---|---|---|
| 1,934,272 | 11/1933 | Miller | 109/64 |
| 2,064,538 | 12/1936 | Hagan | 220/335 X |
| 2,707,808 | 5/1955 | Anderson et al. | 16/180 X |
| 3,067,453 | 12/1962 | Lyons | 16/180 |
| 3,103,996 | 9/1963 | Wyatt, Jr. | 16/180 X |
| 3,307,734 | 3/1967 | Campbell | 16/75 X |
| 3,498,207 | 3/1970 | Hazen | 16/180 X |
| 3,561,162 | 2/1971 | Goldman | 49/386 |

*Primary Examiner*—James Kee Chi

*Attorney, Agent, or Firm*—Seed, Berry, Vernon & Baynham

[57] ABSTRACT

A spring assisted cover construction for an opening is disclosed which is easily opened and which can be laid back adjacent the opening essentially parallel to the plane of the opening if desired. Hinge member means are pivotally connected to the frame surrounding the opening to swing with the door from a lowered position within the opening to a raised position corresponding to the raised position of the door. The hinge member means is also pivotally connected to the door to allow the door to pivot relative to the hinge member means from the raised position to a fully open position adjacent the opening while the hinge member remains stationary. A first pair of torsion rods are arranged to be loaded or stressed when the door is swung down to a closed position from its raised position and a second pair of torsion rods are arranged to be stressed when the door is swung down to its fully open position from its raised position.

10 Claims, 4 Drawing Figures

SPRING ASSISTED DOOR CONSTRUCTION

BACKGROUND OF THE INVENTION

1. Field of the Invention

This invention relates broadly to a torsion bar assist system for opening access doors and particularly to a torsion bar assist system for heavy access doors used to cover underground utility vaults.

2. Description of the Prior Art

The use of a torsion bar assist system for hatchway doors is known and described in U.S. Pat. No. 3,067,453. This patent describes a hatchway cover assembly in which the counterbalancing torsion rods serve the dual function of pivotally hinging a door to the frame as well as exerting a counterbalancing force on the door to facilitate movement thereof.

Access covers for utility vaults have generally been designed to open to a vertical position relative to the plane of the opening; however, the industry has desired an access door which can be laid back flat adjacent the opening so that electrical cable can be pulled and the job accomplished without interference from the upstanding doors.

SUMMARY OF THE INVENTION

It is a primary object of this invention to provide an access door for an opening which utilizes a suspension and hinge system enabling the door to be easily controlled and allowed to be laid back flat adjacent the opening if desired.

It is a further object of this invention to provide an access door for underground utility vaults utilizing dual counterbalancing torsion spring means for opening the access door from its closed position to a vertical position and from a vertical position to a fully open horizontal position adjacent the opening.

It is a further object of this invention to provide an access door for an opening employing hinge member means comprising a pair of spaced hinge members, one pivotally connected to the frame member and the other pivotally connected to the door.

These and other objects are accomplished by a door construction comprising (1) a frame member along one side of an opening, (2) a door having a lowered position closing the opening, a fully open position laid back flat adjacent the opening and a vertical position between the lowered position and the fully open position. Hinge member means are pivotally connected to the frame member to swing with the door from the lowered position within the opening to a vertical position corresponding to the vertical position of the door. The hinge member means is also pivotally connected to the door so that the door may be swung relative to the hinge member means from the vertical position to the fully open position while the hinge member means remains stationary in the vertical position. A first counterbalance spring means is arranged to be loaded or stressed when the door is swung down to a closed position from its vertical position and a second counterbalance spring means is arranged to be stressed when the door is swung down to its fully open horizontal position from the vertical position.

DESCRIPTION OF THE PREFERRED EMBODIMENTS

Figure 1:
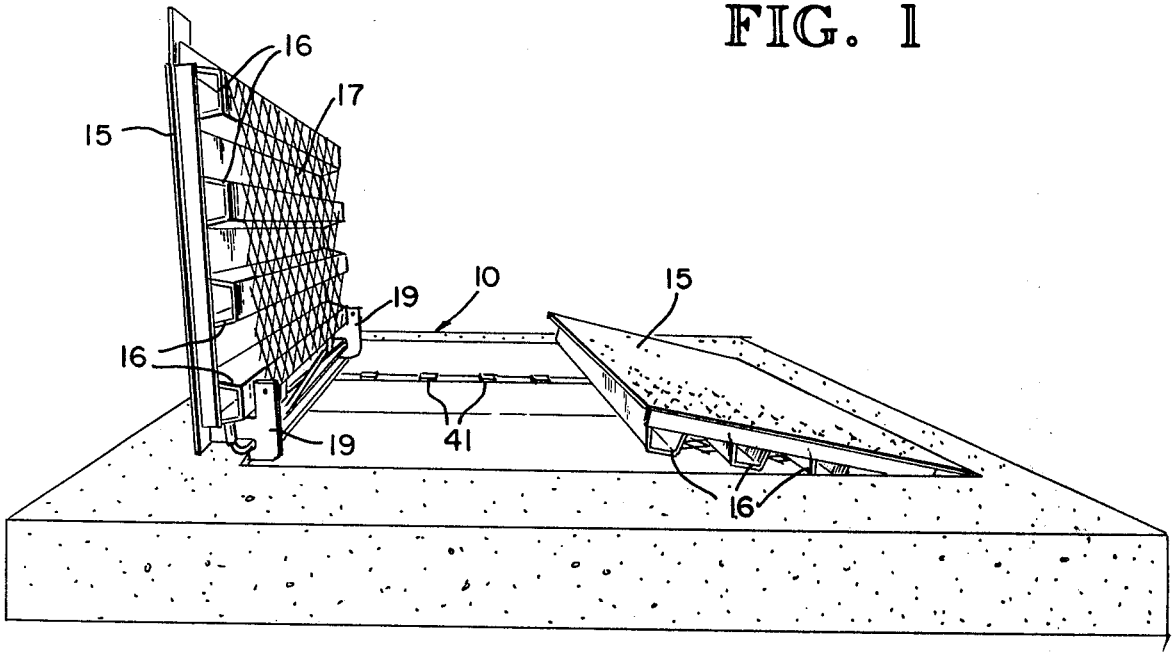
FIG. 1 is a perspective view of a pair of access doors closing a utility vault opening, one door in the vertical position and the other door in a release position where it can be grasped and lifted to the raised position by an operator.
Figure 3:
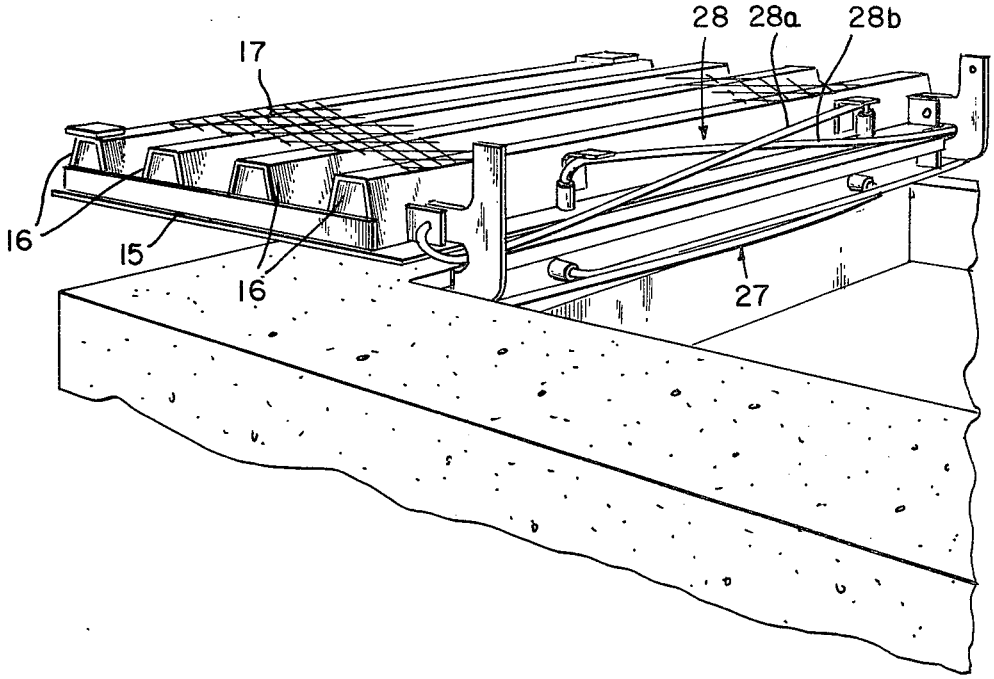
FIG. 3 is a perspective view of one of the doors of FIG. 1 in the fully open horizontal position.

Referring to FIG. 1 an access opening has a frame 10 surrounding the periphery of the opening and a pair of doors 15 hinged to opposite edges of the frame for swinging into abutting relationship to close the access opening in the frame and opening to a fully open position laid back flat adjacent the opening as in FIG. 3 or to a vertical position intermediate the fully open horizontal position and the closed position as in FIG. 1. The frame 10 is C-shaped and includes a bottom surface 11, a sidewall 12 and a upper wall 13. Pairs of hinge brackets 14 are secured to the frame at spaced locations on one side of the opening. Each pair of hinge brackets 14 has a hinge pin bore therein. The doors 15 are of heavy metal, are planar and are reinforced on the under side thereof by parallel reinforcing members 16 at spaced locations extending lengthwise of the doors. The doors may also have a metal mesh 17 covering the upper surface of each of the reinforcing members 16 to provide a planar surface which can be stepped on by an operator when the door is in the fully open position.

Pairs of hinge brackets 18 are secured at spaced locations to the lower edge of each of the doors directly above the pairs of hinge members 14 secured to the frame 10. Each of the pairs of hinge brackets has hinge pin bores therein.

Hinge member means or intermediate hinge members 19 include spaced hinge brackets 20 and 21, one of which is pivotally connected by a hinge pin to the pair of hinge brackets 14 secured to the frame and the other of which is pivotally connected by hinge pins to the pair of hinge brackets 18 secured to the door. The intermediate hinge member means 19 also includes a projecting stop portion 22 which engages the surface 23 of the reinforcing member 16 directly adjacent the pairs of hinge brackets 18. The intermediate hinge member means swings about pivot point 24 with the door 15 from its closed position within the opening to the vertical position illustrated in FIG. 1. The door may then be swung relative to the intermediate hinge member means 19 about pivot point 25 to the fully open horizontal position while the intermediate hinge member means remains stationary in the vertical position. The intermediate hinge member means 19 resembles an upside down F, the arms of the F being the hinge brackets 20 and 21 and the base of the F being the projecting stop 22. Between the spaced arms of the intermediate hinge member means is a U-shaped portion 26.

One end of the torsion bars form the hinge pins for each of the doors 15. Two pairs of torsion bars 27 and 28 are used for each door. The pair of torsion bars **27*a* and 27*b* have a crook 28 at one end with a short portion 29 laterally offset from and parallel to the major longitudinal axis of the rod. The short portion 29 of each rod passes through the aligned hinge bores of the hinge brackets 14 and 20 to pivotally support the intermediate hinge member means in the frame 10. The opposite end of each of the torsion rods is bent at right angles to form a short terminal portion 30 which is in the plane defined by the crooked end of the rod and which is inserted into the socket of a projecting standoff member 31. Torsion rods 27***a* and 27*b* cross each other.

Assembly of the hinge member means 19 to the frame is accomplished by placing the hinge member means with its lower hinge bracket 20 between the pair of hinge brackets 14, aligning the bore openings therein and inserting the short portion 29 of the torsion rod therethrough to pivotally secure the hinge member means to the frame. The opposite end of the torsion bar is then inserted into the socket of one of the standoff members 31. This operation is repeated for the other hinge of the door and for the other door when two doors are employed as illustrated.

Figure 2:
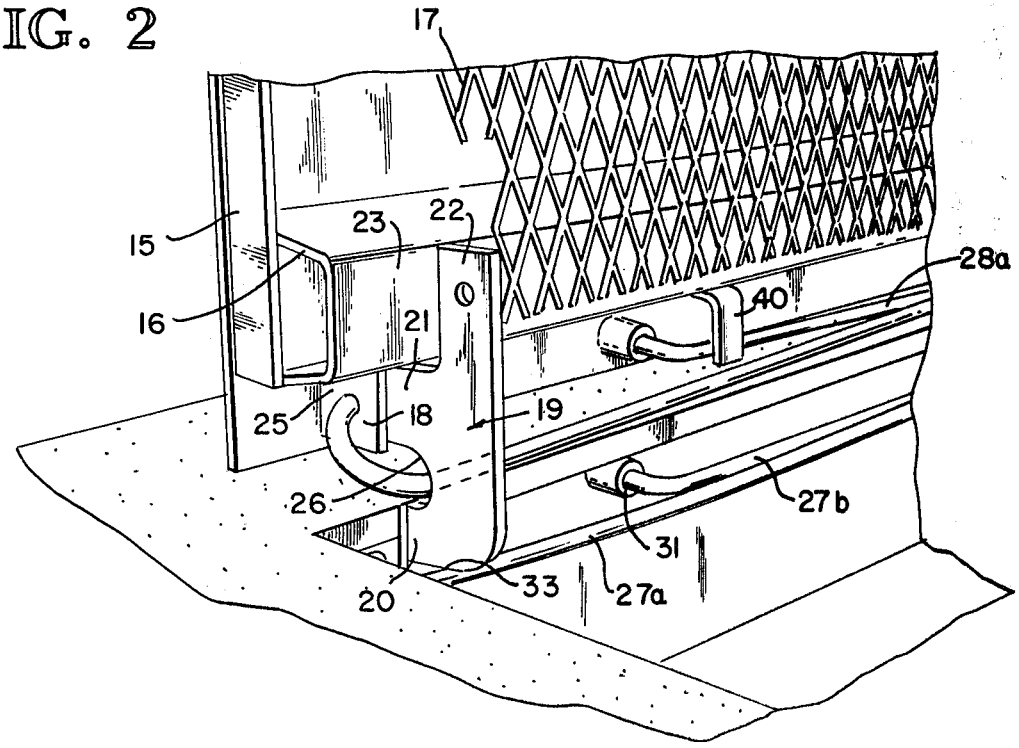
FIG. 2 is a perspective view of the dual hinge arrangement of one of the doors of FIG. 1 when the door is in the vertical position.
Figure 4:
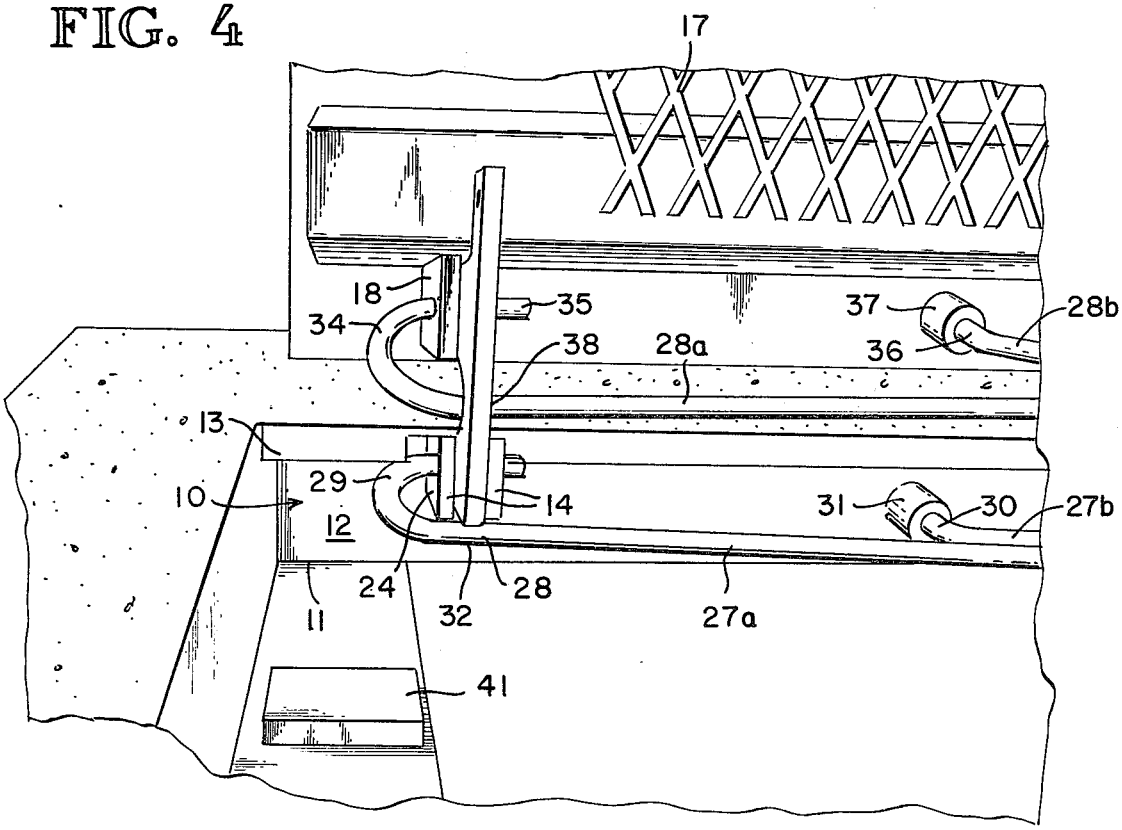
FIG. 4 is a perspective view of the hinge mechanism of one of the doors of FIG. 1.

The laterally offset portion 32 of each torsion rod engages the hinge member means at point 33 as illustrated in FIG. 2. When the door is in the vertical position as illustrated in FIG. 4 the torsion rod bears against the portion 33 of the intermediate hinge member means and counterbalance the weight of the door, preventing it from closing. When the door is swung to the closed position covering the opening, the longitudinal portion of the rod 27*a* is pivoted about its short portion 29, thereby twisting the rod longitudinally of its axis and creating a torsional moment in the rod which counteracts the weight of the door when closing. The door, when in its closed position, is secured in the closed position by suitable locking means (not shown). When the door is released the torsional moment created by previously twisting torsion rods 27*a* and 27*b* assists the operator when lifting the door to the vertical position shown in FIG. 1. When in the vertical position torsion rods 27*a* and 27*b* are under virtually no stress. The amount of torque developed by the pair of torsion rods 27*a* and 27*b* can be controlled by the diameter of the rods. In the vertical position the hinge bracket 20 of the intermediate hinge member means 19 contacts the upper wall 13 of the frame which acts as a stop to prevent further pivot of the hinge member means 19 about pivot point 24.

The torsion rods 28*a* and 28*b* each have a crook 34 at one end with a short portion 35 laterally offset from and parallel to the major longitudinal axis of the rod. The short portion of each rod passes through the aligned hinge bores of the hinge brackets 18 and 21 to pivotally support the door to the intermediate hinge member means 19. The opposite ends of each of the torsion rods 28*a* and 28*b* are bent at right angles to form a short terminal portion 36 which is in the plane defined by the crooked end of the rod and which extends into the socket of a projecting standoff member 37. Torsion rods 28*a* and 28*b* cross each other as illustrated in FIG. 3. Assembly of the hinge member means 19 to the door is accomplished by placing the hinge member means with its upper hinge bracket 21 between the paired hinge brackets 18, aligning the bore openings therein and inserting the short portion 35 of the torsion rod in the aligned hinge bores to pivotally secure the hinge member means to the door. The rod is positioned such that the portion 38 of the rod laterally offset from the pivotal hinge connection engages the intermediate hinge member means 19 in the U-shaped space 26 between the hinge brackets 20 and 21. The opposite end of the torsion rod 28*a* is then twisted the amount necessary to insert it into the socket member 37. The operation is repeated for the other hinge of the door and for the other door when two doors are employed as illustrated.

The laterally offset portions of torsion rods 28*a* and 28*b* engage the intermediate hinge member means as illustrated in FIG. 4 and hold the door against the projecting stop 22 when the door is in the closed or vertical positions. A pushing force by the operator on the door is required to swing the door from its vertical position to its fully open position horizontally adjacent the opening. When the door is swung from the vertical position to the fully open horizontal position it pivots about pivotal axis 25 to twist each of the rods longitudinally of its axis and creating a torsional moment in the rod which counteracts the weight of the door to the fully open position. The amount of torque and sizing of the torsion rods is chosen such that when the door is in its fully open position it lies flat against the opening but can be lifted with little effort by the operator to the vertical position. Generally the torsion rods 28*a* and 28*b* are of lesser size diameter than the torsion rods used to interconnect the hinge member means and the frame member. The amount of torque developed by the second pair of torsion rods is thus less than that required by the first pair of torsion rods.

If desired, pads 41 of a resilient material may be secured along the surface 11 of the frame to contact the surfaces 23 of each of the reinforcing members 16 when the door is in the closed position.

The door construction is economical, essentially maintenance free and allows heavy utility doors covering underground utility vaults to be opened and closed without requiring heavy lifting by the operator.

The embodiments of the invention in which a particular property or privilege is claimed are defined as follows:

1. A counterbalance hinge construction for assisting the opening of heavy access doors covering an opening comprising:

a frame member along one side of the opening, a door having a lowered position closing the opening, a fully open position, and a intermediate position between the lowered and fully open positions, hinge member means pivotally connected to the frame member to pivot and move with the door from the lowered position within the opening to a stationary position corresponding to the intermediate position of the door, the hinge member means also being pivotally connected to the door so that the door may be pivoted about the stationary hinge member means from the intermediate position to the fully open position while the hinge member means remains stationary, first counterbalance spring means arranged to be loaded when the door is swung down to a closed position from its intermediate position, and second counterbalance spring means arranged to be loaded when the door is swung down to its fully open position from its intermediate position.

2. The hinge construction of claim 1 wherein the second counterbalance spring means is pre-loaded so that the hinge member means and door move together from the closed position to the intermediate position.

3. The hinge construction of claim 1 wherein the hinge member means comprises a pair of spaced hinge members, one hinge member pivotally connected to the frame member and the other pivotally connected to the door, the hinge member means also having means projecting as a stop, the second counterbalance spring means being pre-loaded to yieldingly hold the door against the stop when the door is in its intermediate position and being arranged to further torsion load when the door is moved from engagement with the stop to its fully open position.

4. The hinge construction of claim 3 wherein the first counterbalance spring means is a torsion rod means providing, at one end, the pivotal connection betwen the one hinge member of the hinge member means pivotally connected to the frame member and is anchored at the other end to the frame member, the rod means having a portion thereof adjacent to and offset from the pivotal connection which engages the hinge member means as the door is moved to the closed position so as to twist the rod means about its longitudinal axis to produce a torsional moment therein.

5. The hinge construction of claim 4 wherein the second counterbalance spring means is a torsion rod means providing, at one end, the pivotal connection between the other hinge member of the hinge member means pivotally connected to the door and is anchored at the other end to the door, the rod means having a portion thereof adjacent to and offset from the pivotal connection which engages the hinge member means between the spaced hinge members at all times to retain the door against the projecting stop and is twisted further about its longitudinal axis to produce a torsional moment therein as the door is moved from its intermediate position to the fully open position.

6. The hinge construction of claim 5 wherein the torsion rod means of the second counterbalance means is sized so that it assists in raising the door from its fully open position to its intermediate position while allowing the weight of the door to retain the door in the fully open position and the torsion rod means of the first counterbalance spring means is sized to move the door from its closed position toward its intermediate position.

7. The hinge construction of claim 3 wherein the hinge member means has an "F" configuration, the spaced hinge members being the arms of the F and the projecting stop being the base of the F.

8. A hinge construction for assisting the opening of heavy access doors covering the opening of a utility vault, comprising:

a frame positioned about the periphery of the utility vault opening having a horizontal flange portion extending about its periphery, a door hinged to the frame closing the opening and having a lowered position closing the opening with the door resting against the flange of the frame, a fully open position with the door laid with its inner surface facing upwardly essentially parallel to the plane of the opening and an intermediate position between the lowered and fully opened positions, intermediate hinge means including a pair of spaced hinge members, each having bores therein, the first hinge member pivotally connected to the hinge member on the door and the second hinge member pivotally connected to the hinge member on the frame, the intermediate hinge member also having a projecting stop engaging the inner surface of the door when the door is in the closed and intermediate positions, a first torsion rod means comprising a first pair of torsion rods anchored at one end to the frame and extending, at the other end, through the mating bores of the first of the hinge members of the intermediate hinge means and the hinge member on the door, each of the rods having a portion adjacent to and offset from the mating bores which engages the intermediate hinge means as the door is moved to the closed position so as to twist the rod means about its longitudinal axis to produce a torsion moment therein, and a second torsion rod means comprising a second pair of torsion rods anchored at one end to the door and extending, at the other end, through the mating bores of the second of the hinge members of the intermediate hinge means and the hinge member on the door, each of the rods having a portion adjacent to and offset from the mating bores which engages the intermediate hinge means between the spaced hinge members at all times to retain the door against the projecting stop and to be twisted further about its longitudinal axis to produce a torsion moment therein as the door is moved from its intermediate position to its fully open position.

9. The hinge construction of claim 8 including resilient pads spaced about the flange of the frame which the door rests against when in its closed position.

10. The hinge construction of claim 8 including spaced U-shaped reinforcing members extending lengthwise of the door in parallel relation to reinforce the door against bending stresses.

* * * * *